US010903604B2

(12) United States Patent
Mamiya et al.

(10) Patent No.: US 10,903,604 B2
(45) Date of Patent: Jan. 26, 2021

(54) CONNECTOR WITH A HOUSING THAT RESTRICTS EXCESSIVE DEFLECTION OF THE LOCK ARM

(71) Applicant: Sumitomo Wiring Systems, Ltd., Mie (JP)

(72) Inventors: Yuma Mamiya, Mie (JP); Shinjiro Kida, Mie (JP); Sho Saito, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/676,514

(22) Filed: Nov. 7, 2019

(65) Prior Publication Data

US 2020/0153161 A1 May 14, 2020

(30) Foreign Application Priority Data

Nov. 14, 2018 (JP) ..... 2018-213440

(51) Int. Cl.
*H01R 13/627* (2006.01)
*H01R 13/633* (2006.01)
*H01R 13/639* (2006.01)
*H01R 13/641* (2006.01)

(52) U.S. Cl.
CPC ..... *H01R 13/6272* (2013.01); *H01R 13/633* (2013.01); *H01R 13/639* (2013.01); *H01R 13/641* (2013.01)

(58) Field of Classification Search
CPC ..... H01R 13/6272; H01R 13/633; H01R 13/639; H01R 13/641; H01R 13/6271; H01R 13/6275; H01R 13/6295
USPC ..... 439/153, 352, 357, 358, 488, 489
See application file for complete search history.

(56) References Cited

U.S. PATENT DOCUMENTS 5,507,666 A * 4/1996 Yamanashi ..... H01R 13/641 439/489
5,643,003 A * 7/1997 Myer ..... H01R 13/6272 439/352
6,261,116 B1 * 7/2001 Ceru ..... H01R 13/6272 439/352
6,435,895 B1 * 8/2002 Fink ..... H01R 13/6272 439/352
6,908,329 B2 * 6/2005 Kozono ..... H01R 13/641 439/352

(Continued)

FOREIGN PATENT DOCUMENTS

JP 2015-215985 12/2015

*Primary Examiner* — Travis S Chambers
(74) *Attorney, Agent, or Firm* — Gerald E. Hespos; Michael J. Porco; Matthew T. Hespos

(57) ABSTRACT

It is aimed to provide a connector capable of being simplified in configuration. A connector (10) includes a housing (20) configured to be fit to hold a mating housing (61) by a resiliently deflectable lock arm (40), and a detecting member (50) configured such that a movement from a standby position to a detection position is restricted in a state where the housing (20) and the mating housing (61) are not properly connected and a movement to the detection position is allowed in a properly connected state of the housing (20) and the mating housing (61). The lock arm (40) includes stopper (44) configured to stop the detecting member (50) in contact therewith in the properly connected state. The housing (20) includes a covering wall (35) with which the stoppers (44) come into contact in a deflecting direction of the lock arm (40).

4 Claims, 12 Drawing Sheets

(56) References Cited

U.S. PATENT DOCUMENTS

| | | | | |
|---|---|---|---|---|
| 9,490,574 | B2 * | 11/2016 | Kon | H01R 13/627 |
| 2004/0067676 | A1 * | 4/2004 | Nimura | H01R 13/641<br>439/352 |
| 2004/0248453 | A1 * | 12/2004 | McLauchlan | H01R 13/6272<br>439/352 |

* cited by examiner

CONNECTOR WITH A HOUSING THAT RESTRICTS EXCESSIVE DEFLECTION OF THE LOCK ARM

BACKGROUND

Field of the Invention

The invention relates to a connector.

Related Art

Japanese Unexamined Patent Publication No. 2015-215985 discloses a connection detection connector with a detecting member for detecting whether or not a connector housing is connected properly to a mating connector. The connector housing is formed with a lock arm to be resiliently deflected to lock the mating connector and with an arched restricting wall outside the lock arm. The lock arm is prevented from being deformed excessively by contact the restricting wall when being deflected while the connectors are being connected.

The detecting member disclosed in Japanese Unexamined Patent Publication No. 2015-215985 is configured to restrict a movement toward the mating connector from a detection position. For example, a wall extending in a direction perpendicular to a moving direction is provided on a rear end of the detecting member and is capable of interfering with the connector housing. However, this configuration requires the detecting member to be provided with the wall and has a problem of being complicated. Even in the case of restricting such a movement of the detecting member, a connector having a simple configuration is required.

The invention was completed on the basis of the above situation and aims to provide a connector capable of being simplified in configuration.

SUMMARY

The invention is directed to a connector with a housing configured to be fit to a mating housing. The housing has a resiliently deflectable lock arm to hold the housing and the mating housing together. The connector also has a detecting member configured such that a movement from a standby position to a detection position is restricted in a state where the housing and the mating housing are not connected properly and a movement to the detection position is allowed in a properly connected state of the housing and the mating housing. The lock arm includes a stopper configured to stop the detecting member in contact therewith in the properly connected state, and the housing includes a contact portion. The stopper contacts the contact portion in a deflecting direction of the lock arm.

The lock arm includes the stopper configured to stop the detecting member in contact therewith in the properly connected state. In this way, the stopper can restrict a movement of the detecting member from the detection position by stopping the detecting member. Further, the housing includes the contact portion that contacts the stopper in the deflecting direction of the lock arm. In this way, the contact of the stopper with the contact portion prevents further deflection of the lock arm can. As just described, the connector has a function of restricting a movement of the detecting member from the detection position and a function of restricting excessive deflection of the lock arm. These two functions need not be performed by separate configurations. Therefore, the connector can be simplified.

The lock arm may have a releasing portion configured to release connection of the housing and the mating housing. The stopper may be integral to the releasing portion. Thus, the lock arm can be simplified by integrating the stopper and the releasing portion.

The stopper may be integral to the releasing portion on a free end side of the lock arm. Accordingly, the free end of the lock arm can be prevented from being deflected and deformed with the stopper held in contact with the contact portion. Thus, excessive deflection of the lock arm can be prevented reliably.

The lock arm may have two of the stoppers and may be connected to the stoppers via the releasing portion. According to this configuration, the releasing portion functions as a beam between the stoppers so that the rigidity of the lock arm can be ensured.

DETAILED DESCRIPTION

Figure 10:
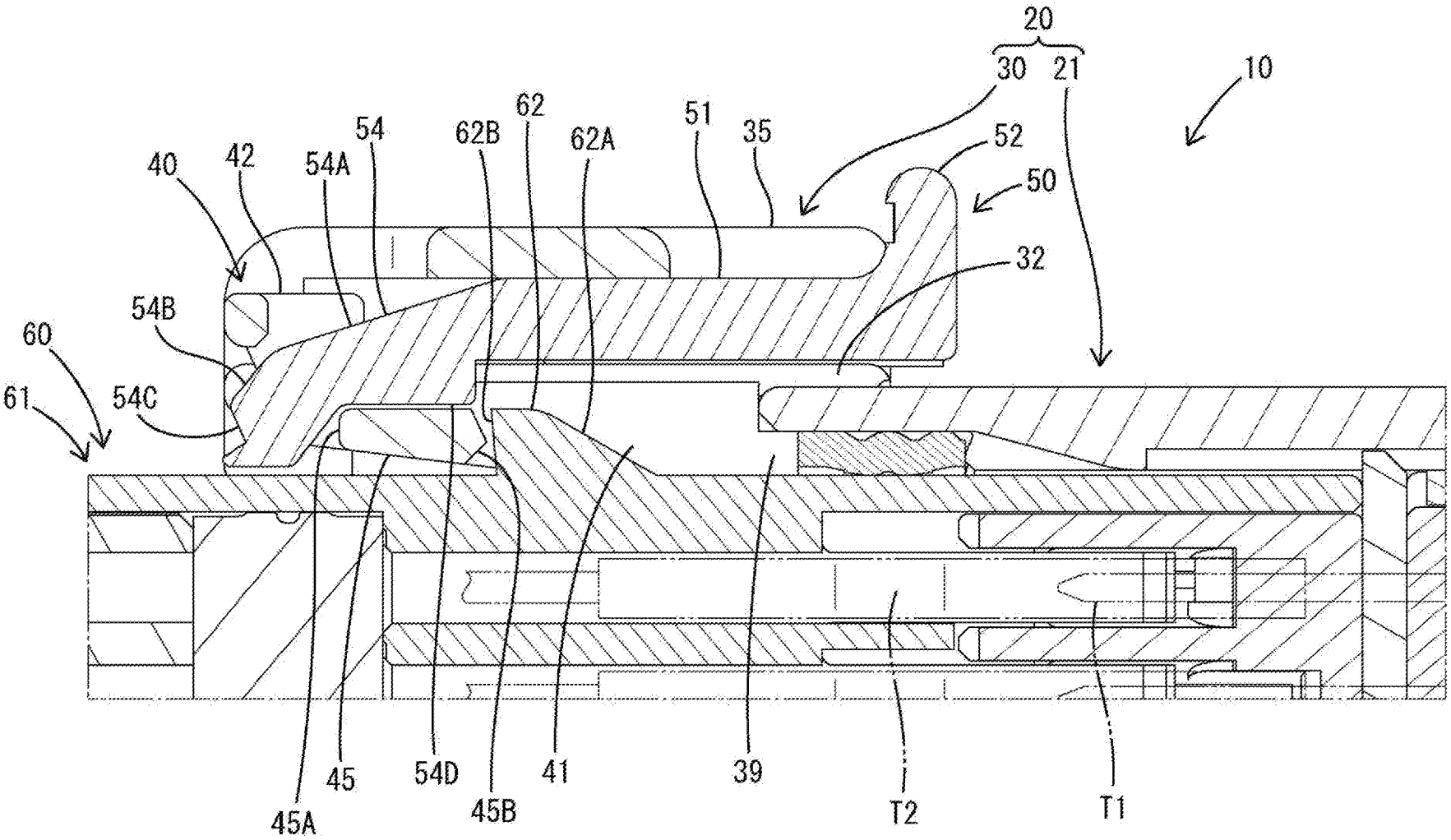
FIG. 10 is a plan view in section showing a state where the detecting member is at a detection position with the connector and the mating connector properly connected.
Figure 11:
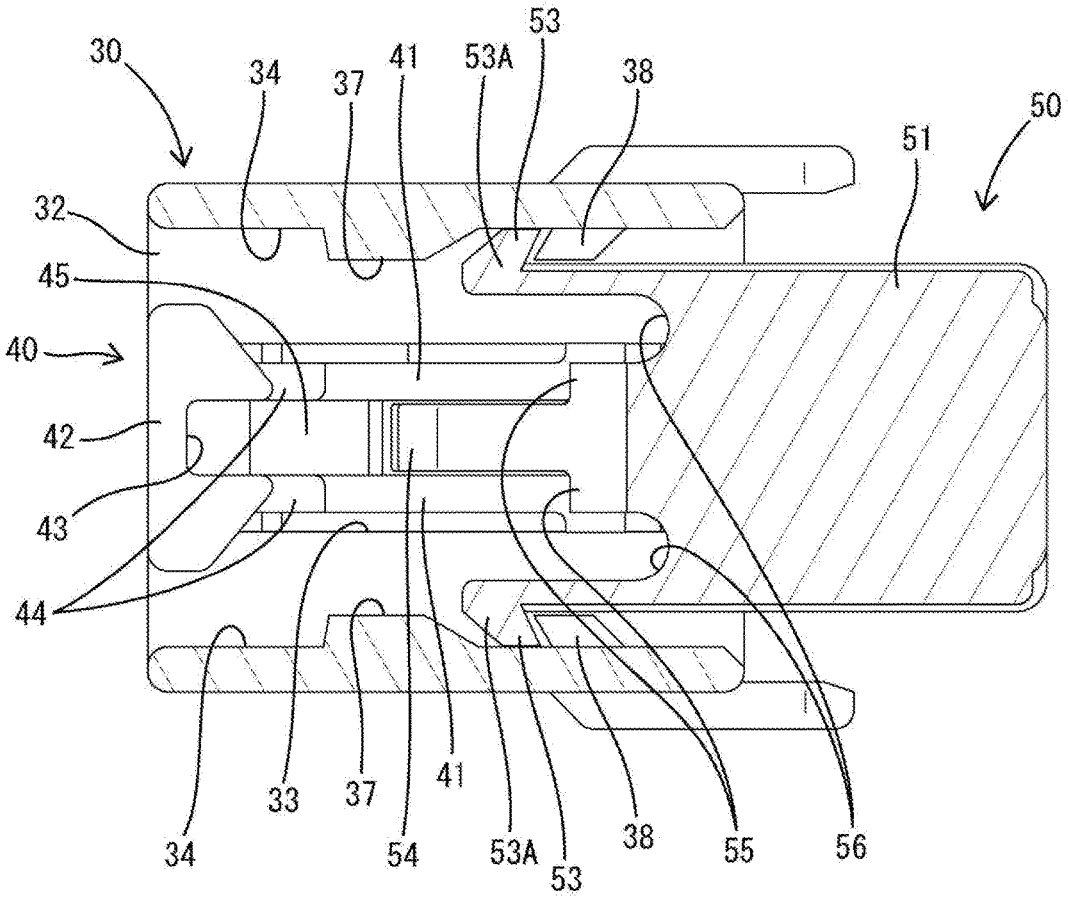
FIG. 11 is a side view in section showing a state where the detecting member is at the standby position with respect to the lock holder.
Figure 12:
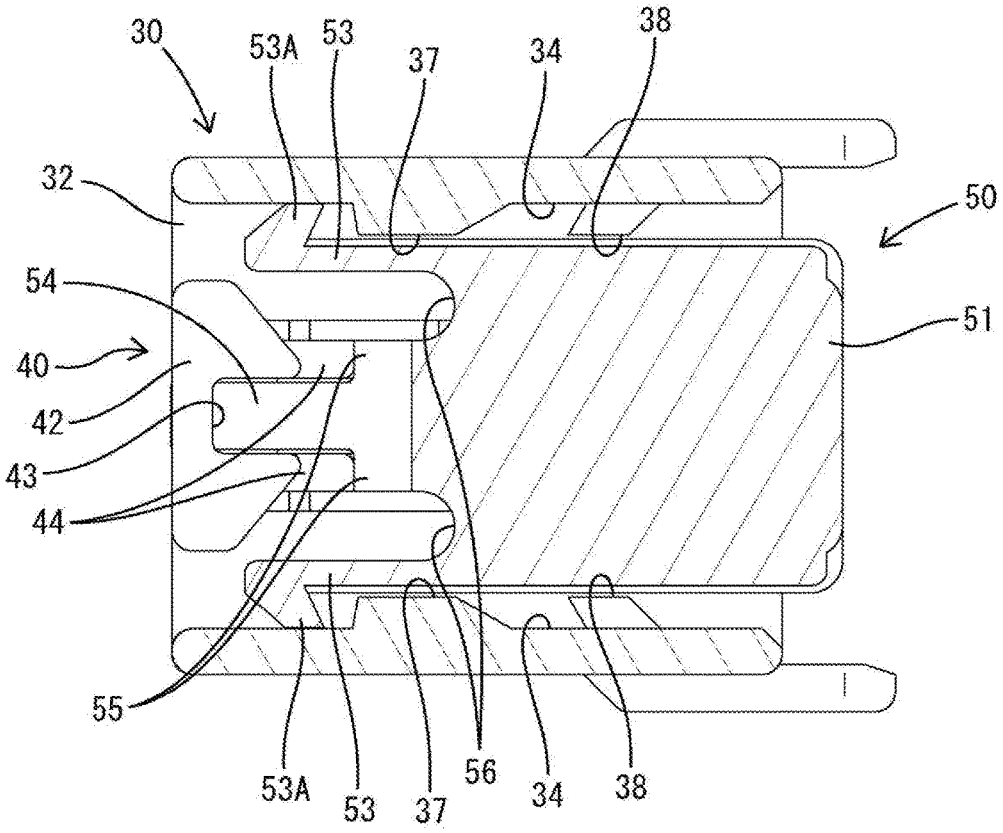
FIG. 12 is a side view in section showing a state where the detecting member is at the detection position with respect to the lock holder.

An embodiment of the present invention is described with reference to FIGS. 1 to 13. Note that, in the following description, left and right sides in FIGS. 8 to 13 are defined as front and rear sides concerning a front-rear direction. Upper and lower sides shown in FIGS. 8 to 10 and 13 are defined as right and left sides concerning a lateral direction. Upper and lower sides shown in FIGS. 11 and 12 are defined as upper and lower sides concerning a vertical direction.

Figure 1:
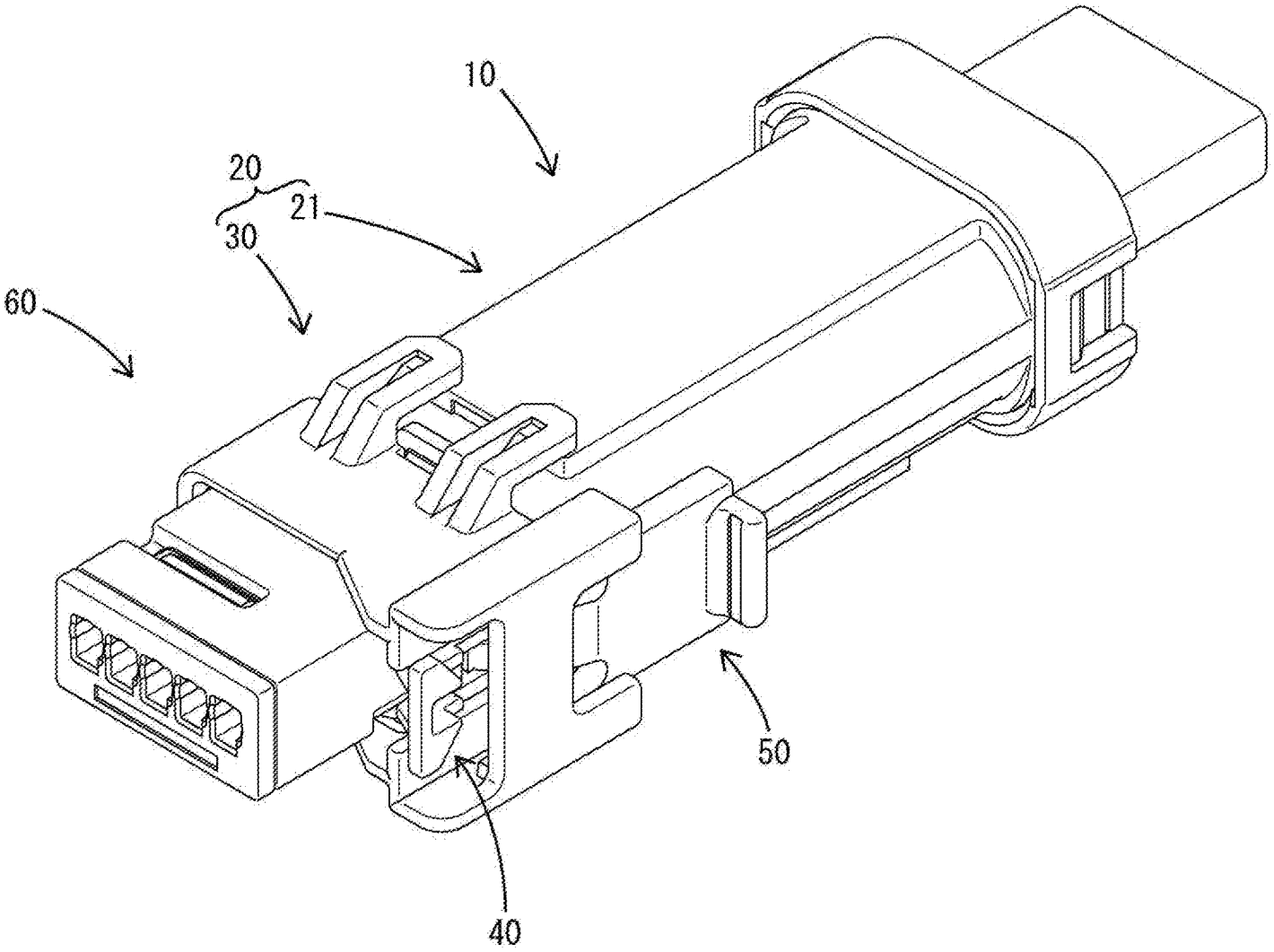
FIG. 1 is a perspective view showing a state where a mating connector is connected to a connector of one embodiment.
Figure 2:
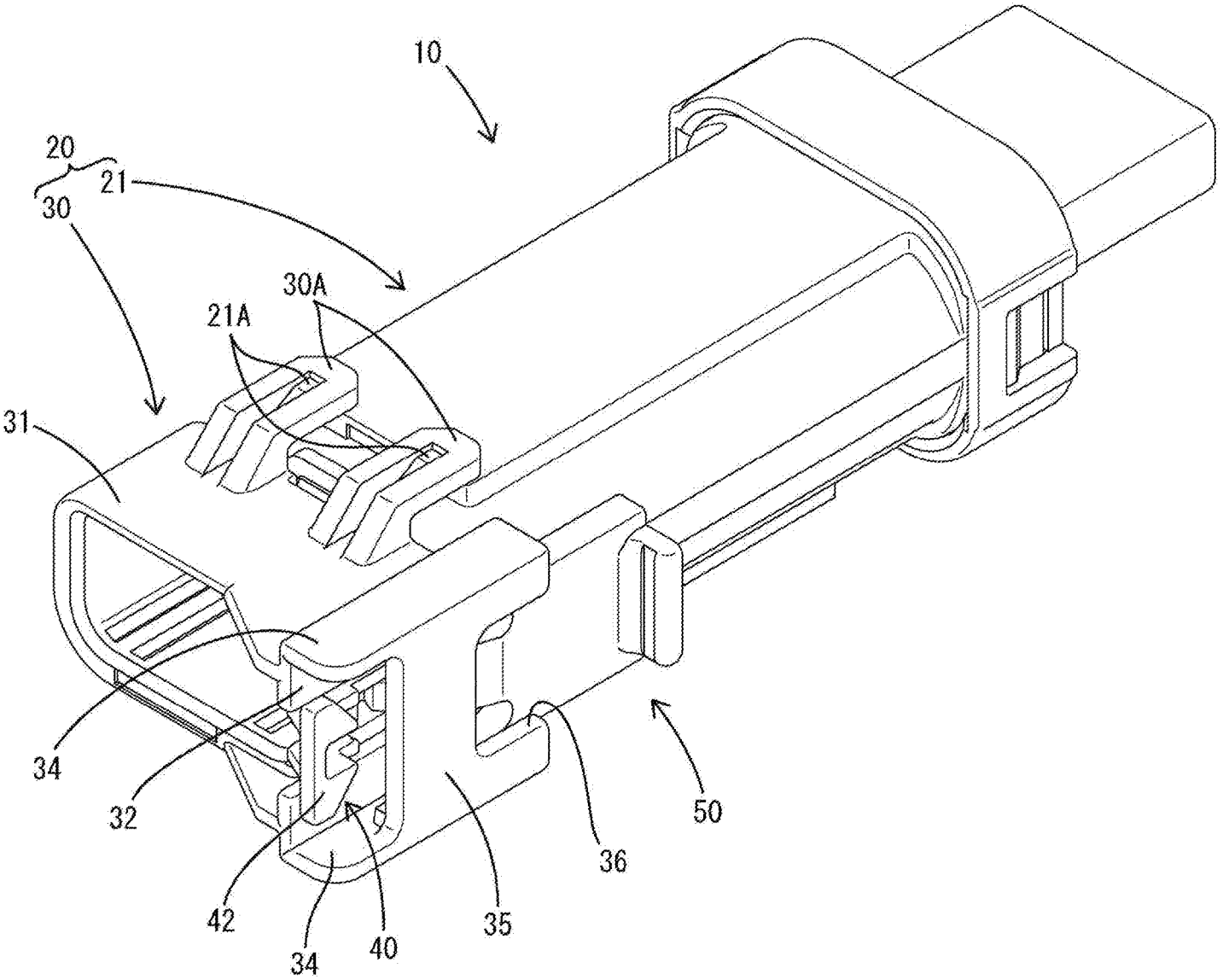
FIG. 2 is a perspective view of the connector.

A connector 10 of this embodiment, as shown in FIG. 1, is male connector for a wiring harness of an automotive vehicle and is connected to a mating connector 60 constituted as a female connector. As shown in FIG. 2, the connector 10 includes a housing 20, terminal fittings T1 (see FIG. 8) and a detecting member 50.

As shown in FIG. 2, the housing 20 includes a housing body 21 and a lock holder 30. Note that a detailed configuration inside the housing body 21 is not shown in FIG. 3. The housing body 21 is made of synthetic resin and includes a terminal accommodating portion (not shown) configured to accommodate and hold the male terminal fittings T1 connected to end parts of unillustrated wires. As shown in FIG. 2, the housing body 21 is formed with locked portions 21A (only those on an upper side are shown in FIG. 2) to be locked by the lock holder 30 on both upper and lower surfaces.

Figure 3:
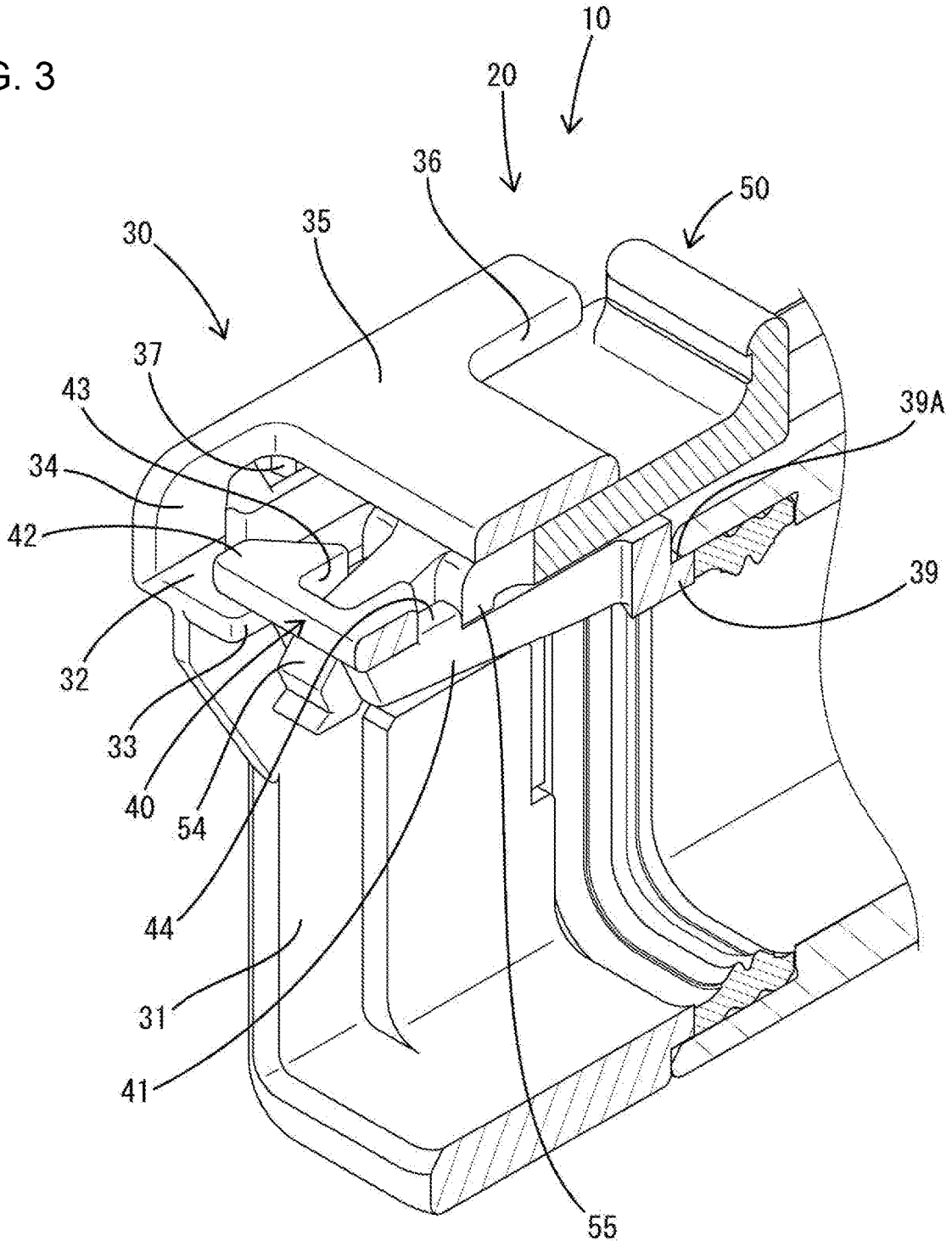
FIG. 3 is a perspective view with a plan view in section of a front part of the connector when viewed obliquely from below.

As shown in FIGS. 2 and 3, the lock holder 30 is assembled on the side of an opening end part (front end part) of the housing body 21. The lock holder 30 is fit to hold a mating housing 61 (member constituting an outer shell of the mating connector 60) in a locked state by a lock arm 40 to be described later locking the mating housing 61. The lock holder 30 is made of synthetic resin and is a substantially rectangular tube. The lock holder 30 is formed with locking portions 30A for locking the locked portions 21A of the housing body 21 on both upper and lower surfaces (only those on the upper side are shown in FIG. 2).

Figure 4:
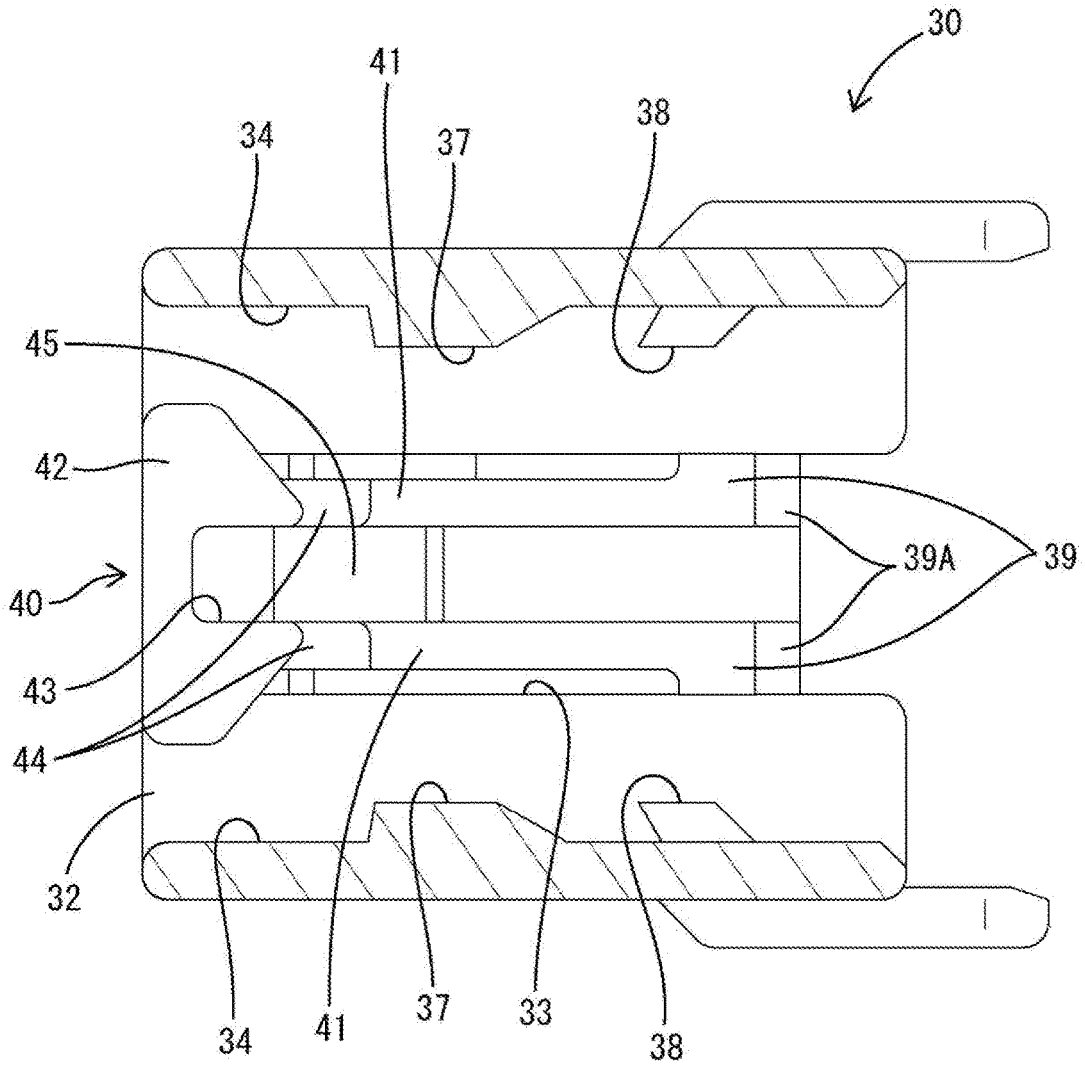
FIG. 4 is a side view in section of a lock holder.

As shown in FIGS. 3 and 4, the lock holder 30 includes a tubular portion 31, a side wall 32, protection walls 34, a covering wall portion 35, first holding projections 37, second holding projections 38, supports 39 and the lock arm 40. The tubular portion 31 is a substantially rectangular tube, and the side wall 32, the protection walls 34, the covering wall 35, the first holding projections 37, the second holding projections 38 and the lock arm 40 are provided on one side (right side). As shown in FIG. 2, a wall on the right side of the tubular portion 31 is constituted by the side wall 32. The side wall 32 projects farther vertically out than the other parts of the tubular portion 31. The side wall 32 is formed with an opening 33 open forward while leaving only a rear end part in a vertically central region. The side wall 32 is cut at a location where the lock arm 40 is formed (see FIG. 3).

As shown in FIGS. 3 and 4, two of the protection walls 34 extend substantially parallel to each other on both upper and lower ends of the side wall 32. The covering wall 35 is connected to the protection walls 34 and covers the lock arm 40 from outside. The covering wall 35 is a part corresponding to a "contact portion" of the present invention and configured to come into contact with stoppers 44 to be described later in a deflecting direction of the lock arm 40. The covering wall 35 is formed in a part excluding front end parts of the respective protection walls 34 in the front-rear direction. An opening 36 open rearward is formed in a rear end part of the covering wall 35.

As shown in FIG. 4, the first holding projection 37 is formed in a center of the inner surface (surface facing the other protection wall 34) of the protection wall 34 in the front-rear direction. The first holding projection 37 is provided at a position laterally overlapping the covering wall 35 (position covered by the covering wall 35) on the protection wall 34. Each end of the first holding projection 37 in the front-rear direction is tapered to gradually narrow a width in the front-rear direction toward an inner side (toward the other protection wall 34).

As shown in FIG. 4, the second holding projection 38 is provided behind the first holding projection 37 on the inner surface (surface facing the other protection wall 34) of the protection wall 34. Each end part of the second holding projection 38 in the front-rear direction is inclined forward.

As shown in FIG. 4, two of the supports 39 extend vertically from inner sides of both upper and lower walls of the tubular portion 31 toward the other walls. The tips of the supports 39 are separated from each other. Recesses 39A recessed forward are formed in outer edge parts on rear end sides of the supports 39. As shown in FIG. 3, the front end of the housing body 21 is fit into the recesses 39A.

As shown in FIGS. 3 and 4, the lock arm 40 is in the form of a lever long in the front-rear direction as a whole. The lock arm 40 is supported by the two supports 39 and can be inclined and displaced with the supports 39 substantially as a fulcrum. The lock arm 40 includes arm portions 41, a releasing portion 42, the stoppers 44 and a locking portion 45. The arm portions 41 are in the form of strips. Two of the arm portions 41 extend forward from inner end parts of the pair of supporting portions 39.

The releasing portion 42 functions to release the connection of the housing 20 and the mating housing 61. The releasing portion 42 has a home base shape (front part has a substantially rectangular shape and rear part is shaped to be gradually narrower toward a rear side) cut in a part (part from a rear end to a center). The tips of the arm portions 41 are coupled to one side surface (left side surface) of the releasing portion 42. The releasing portion 42 is formed with a recess 43 cut from the rear end to the vicinity of the center on a vertically central side. The recess 43 is substantially square when viewed in the lateral direction.

The arm portions 41 are formed with the stoppers 44 at positions behind the releasing portion 42 in the front-rear direction. The stoppers 44 function to stop the detecting member 50 in contact therewith in a properly connected state of the housing 20 and the mating housing 61. The stoppers 44 are projecting pieces projecting rightward (toward the covering wall 35) and are coupled integrally to the releasing portion 42 at adjacent positions on a free end of the lock arm 40. The configuration of the lock arm 40 is simplified by integrating the stoppers 44 and the releasing portion 42 in this way. Since the stoppers 44 are coupled integrally to the releasing portion 42 on the free end of the lock arm 40, the free end can be prevented from being deflected and deformed with the stoppers 44 held in contact with the covering wall 35 as described later. Thus, the free end can be prevented from being deflected and deformed. The stoppers 44 are connected via the releasing portion 42. Thus, the releasing portion 42 functions as a beam between the two stoppers 44 so that the rigidity of the lock arm 40 can be ensured.

As shown in FIGS. 4 and 8 to 10, the locking portion 45 is continuous with the respective arm portions 41 between the arm portions 41 and is provided at the same position as the stoppers 44 in the front-rear direction. A front part 45A of the locking portion 45 is rounded. One side surface (right side surface) of the locking portion 45 is a substantially horizontal flat surface (substantially parallel to the front-rear direction). The other side surface (left side surface) of the locking portion 45 extends along the other side surfaces (left side surfaces) of the arm portions 41 and is inclined to be higher toward the front. A rear end part 45B of the locking portion 45 corresponds to the shape of a recess 54C of the detecting member 50 to be described later, has a triangular shape when viewed in the vertical direction, and has a lateral width gradually narrowed toward the rear.

Figure 5:
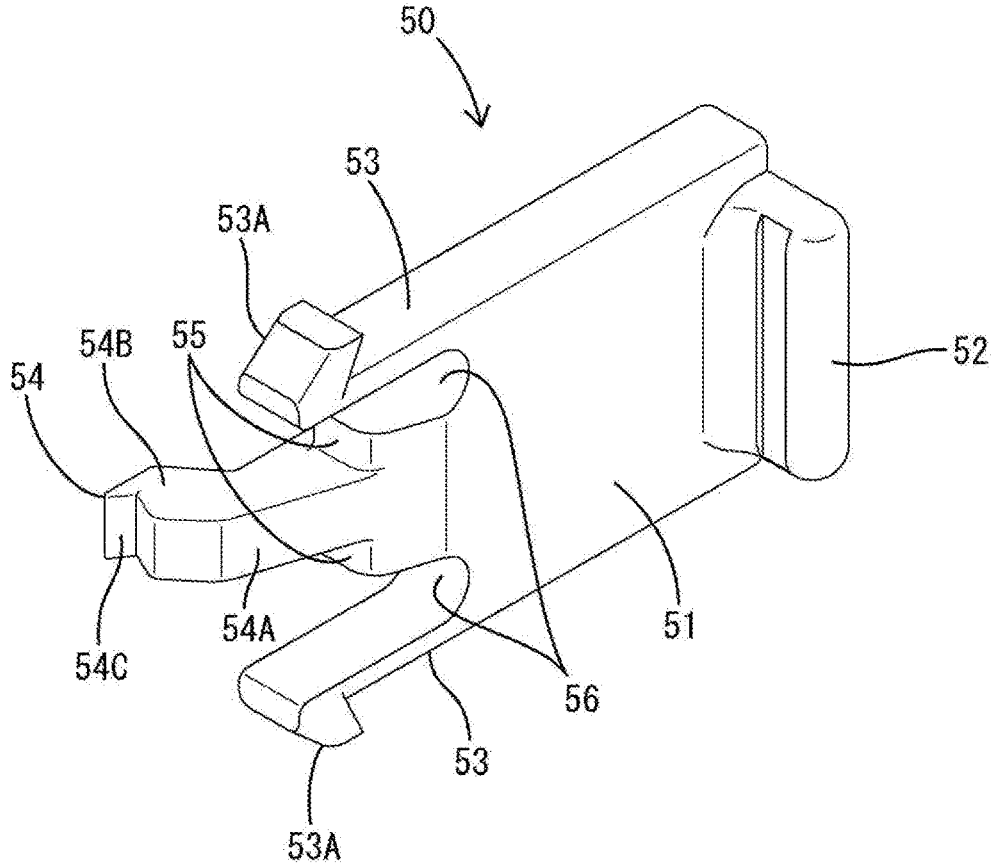
FIG. 5 is a perspective view of a detecting member.
Figure 6:
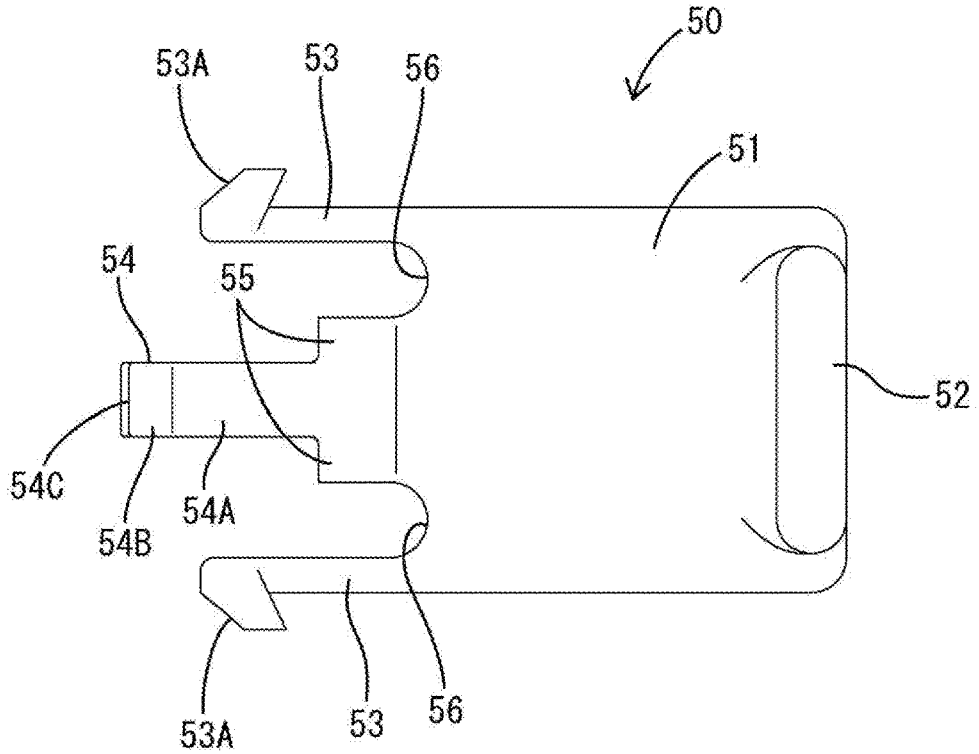
FIG. 6 is a plan view of the detecting member.
Figure 7:
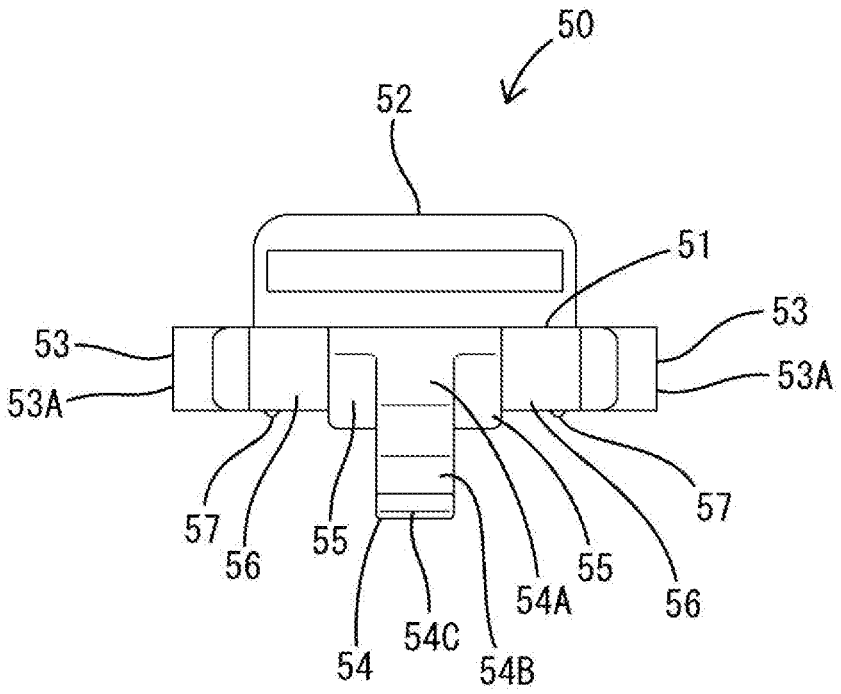
FIG. 7 is a front view of the detecting member.

As shown in FIGS. 5 to 7, the detecting member 50 includes a flat plate 51, a rear wall 52, outer locking arms 53, an inner locking arm 54, projections 55 and grooves 56. The detecting member 50 is made of synthetic resin and is configured to detect a connected state of the housing 20 and the mating housing 61. The detecting member 50 is restricted from moving from a standby position to a detection position in a state where the housing 20 and the mating housing 61 are not connected properly and can move to the detection position in the properly connected state of the housing 20 and the mating housing 61.

Figure 8:
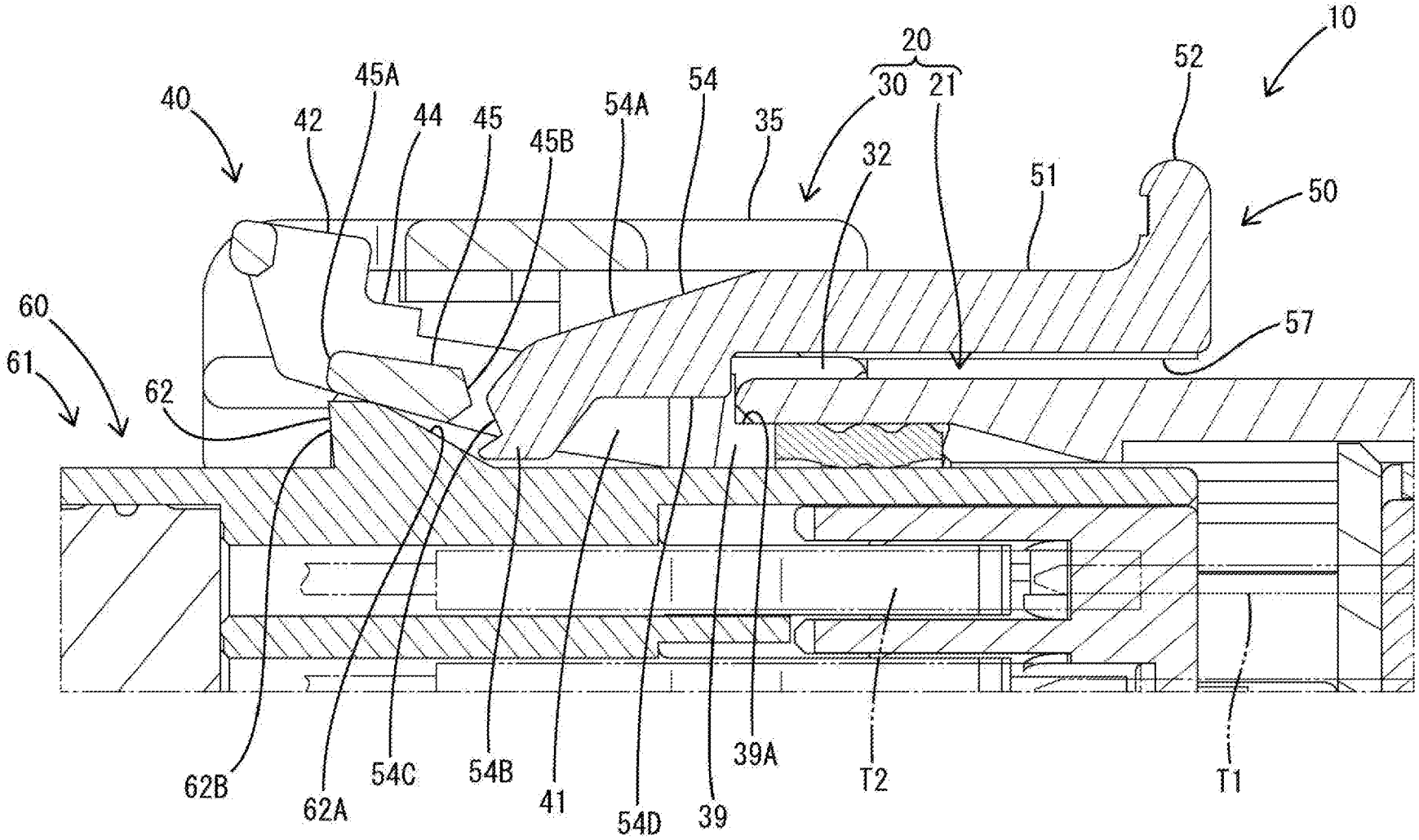
FIG. 8 is a plan view in section showing an incompletely connected state of the connector and the mating connector.

As shown in FIGS. 5 to 7, the flat plate 51 is a substantially flat plate. As shown in FIGS. 7 and 8, two rails 57 are formed along the front-rear direction on the bottom surface of the flat plate 51. As shown in FIG. 8, the flat plate 51 is in contact with the side wall 32 via the rails 57 in a state of the detecting member 50 assembled with the lock holder 30. The rear wall 52 rises along the rear end of the flat plate 51. The rear wall 52 is substantially at a right angle to plate surfaces of the flat plates 51.

As shown in FIGS. 5 to 7, two of the outer locking arms 53 extend forward from both upper and lower end parts of the front end of the flat plate 51. The outer locking arms 53 are strips and can be deflected and deformed in the vertical direction. Hook-shaped locking portions 53A are formed on the tips of the outer locking arms 53. Each locking portion 53A projects out (toward a side opposite to the other outer locking portion 53) from the tip of the outer locking arm 53.

As shown in FIGS. 5 to 7, the inner locking arm 54 extends forward and leftward (toward a side opposite to a rising direction of the rear wall portion 52) from a vertically central location of the front end of the flat plate portion 51. The inner locking arm 54 can be deflected and deformed in the lateral direction (direction perpendicular to the plate surfaces of the flat plate 51). A width of the inner locking arm 54 in the vertical direction (facing direction of the outer locking arms 53) is constant from a base end toward a tip. The inner locking arm 54 includes a first arm portion 54A and a locking portion 54B. The first arm portion 54A is constituted by a rear end side of the inner locking arm 54 and an extending direction thereof is inclined with respect to the plate surfaces of the flat plate 51. The locking portion 54B is a front end of the inner locking arm 54, and an extending direction thereof is more inclined with respect to the plate surfaces of the flat plate 51 than the first arm portion 54A. The front surface of the locking portion 54B is formed with the recess 54C recessed rearward. The recess 54C corresponds to the shape of the rear end part 45B of the locking portion 45, is recessed to have a triangular shape when viewed in the vertical direction, and has a lateral width gradually narrowed toward the rear. A bottom surface 54D (see FIG. 8) of the inner locking arm 54 is located to the left of the flat plate 51 and forms a step together with the flat plate 51.

The projections 55 are stopped in contact with the stoppers 44 with the housing 20 and the mating housing 61 properly connected. Two of the projections 55 project respectively on upper and lower sides of the base end of the inner locking arm 54. The front surface of the projection 55 is a flat surface perpendicular to the plate surfaces of the flat plate 51. The right surface of the projection 55 is inclined with respect to the front-rear direction to be connected to the right surface of the inner locking arm 54. The projection 55 is separated from the outer locking arm 53. The groove 56 is recessed rearward with the projecting portion 55 and the outer locking arm 53 serving as side walls. The rear end of the groove 56 is curved when viewed in the lateral direction.

Next, a connecting operation of the connector 10 and the mating connector 60 is described.

First, the detecting member 50 is arranged at the standby position. As shown in FIG. 8, lateral movements of the detecting member 50 are restricted by inserting the flat plate portion 51 between the side wall 32 and the covering wall 35. The locking portions 53A can respectively contact with the protection walls 34 from inside, as shown in FIG. 11, to restrict vertical movements of the detecting member 50. Note that the two locking portions 53A are located between the first holding projections 37 and the second holding projections 38 by riding over the second holding projections 38 from behind to deflect and deform the outer locking arms 53 inwardly. Since the inner locking arm 54 is inserted between the two arm portions 41, vertical movements of the detecting member 50 are restricted.

When the mating housing 61 enters the housing 20, the terminal fittings T1 are inserted gradually into mating terminal fittings (so-called female terminals) T2 accommodated in the mating housing 61, as shown in FIG. 8. A lock protrusion 62 is formed on the outer surface of the mating housing 61. A rear end (end part on the side of the housing 20) 62A of the lock protrusion 62 is inclined to be more outward toward the rear. A front end (end part opposite to the housing 20) 62B of the lock protrusion 62 is inclined slightly forward toward an outer side. The rear end of the lock protrusion 62 and the front part 45A of the locking portion 45 come into contact and the locking portion 45 gradually rides on the lock protrusion 62. Then, the lock arm 40 obliquely deforms resiliently.

In such an incompletely connected state of the connectors (incompletely connected state where the connector housings are not properly connected yet), if an attempt is made to move the detecting member 50 forward, the recess 54C is locked to the rear part 45B of the locking portion 45. Then, a locked state of the recess 54C and the rear part 45B of the locking portion 45 is held, and the detecting member 50 cannot be moved forward from the standby position toward the detection position.

Figure 9:
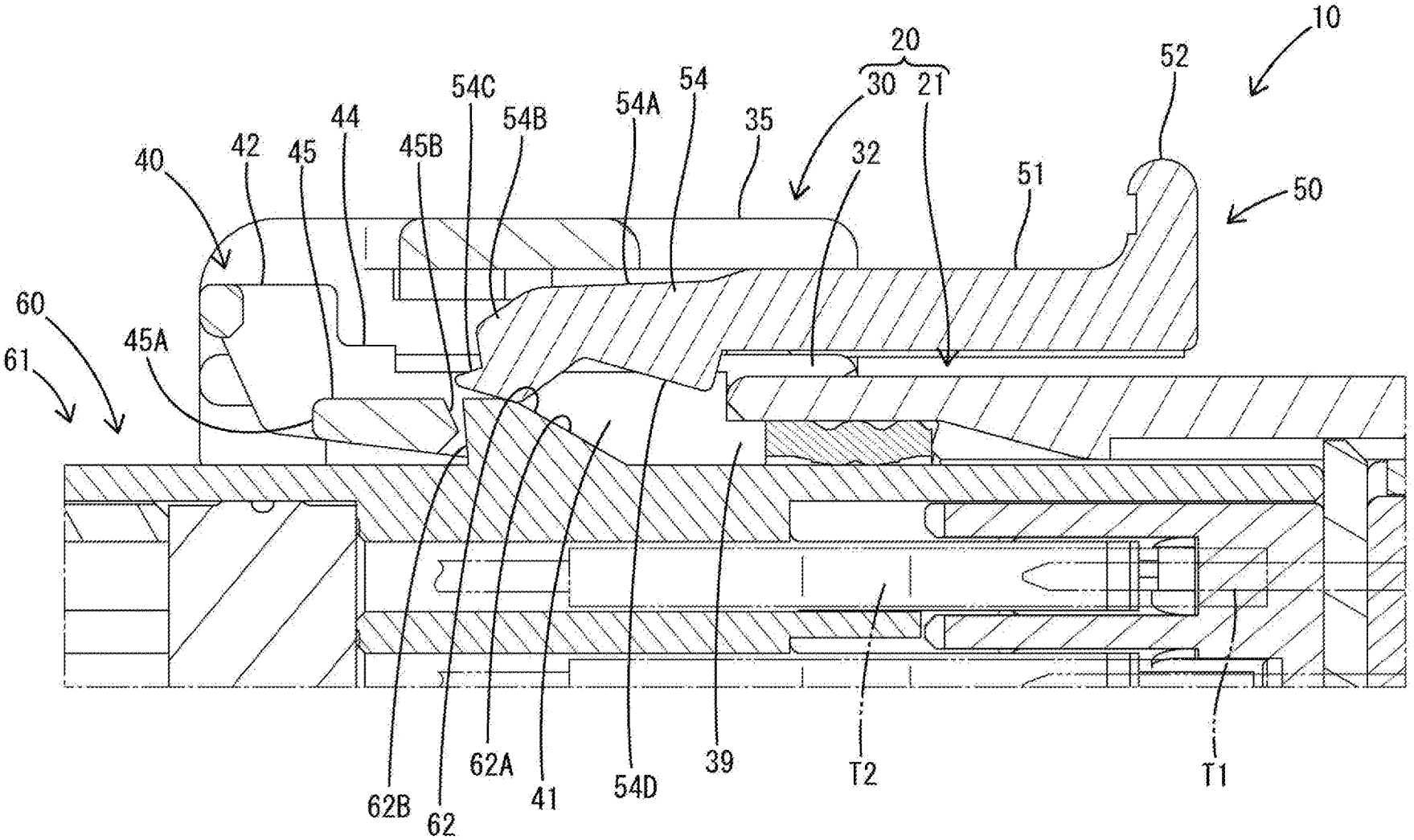
FIG. 9 is a plan view in section showing a state where the detecting member is at a standby position with the connector and the mating connector properly connected.

When the connectors reach a properly connected state as shown in FIG. 9, the mating terminal fittings T2 and the terminal fittings T1 are connected properly. Further, the locking portion 45 rides over the lock protrusion 62, the lock arm 40 resiliently returns, the rear end part 45B of the locking portion 45 and the front end 62B of the lock protrusion 62 are arranged to face each other in the front-rear direction, and the housings are locked in the properly connected state. In the properly connected state of the housings, the detecting member 50 is allowed to move to the detection position.

Subsequently, the detecting member 50 is moved from the standby position to the detection position. If the rear surface of the detecting member 50 is pushed forward, the tip of the inner locking arm 54 butts against the rear end 62A of the lock protrusion 62. In this way, the tip of the inner locking arm 54 is displaced up by the inclination of the rear end 62A of the lock protrusion 62 and slides forward in contact with the outer surface of the lock protrusion 62, as shown in FIG. 9. Then, the inner locking arm 54 passes over the lock protrusion 62 and the locking portion 45 and resiliently returns downward.

If the rear surface of the detecting member 50 is pushed forward in moving the detecting member 50 from the standby position to the detection position, the locking portions 53A of the outer locking arms 53 respectively butt against the rear ends of the first holding projections 37 from the state shown in FIG. 11. In this way, the outer locking arms 53 are displaced in toward the other outer locking arms 53 by the inclination of the rear ends of the first holding projections 37, and slide forward on the first holding projections 37. Then, as shown in FIG. 12, the outer locking arms 53 pass over the first holding projections 37 and resiliently return outward. The detecting member 50 is restricted from moving forward and held at the detection position by the projections 55 contacting the stoppers 44 from behind to be stopped in contact with the stoppers 44.

As described above, the inner locking arm 54 rides over the lock protrusion 62 and the locking portion 45, and the outer locking arms 53 ride over the first holding projections 37. Thus, the detecting member 50 reaches the detection position as shown in FIGS. 10 and 12. During this time, a worker feels a strong resistance force and feels a lightening response when the resistance force is released. The locking portion 54B of the inner locking arm 54 and the front part 45A of the locking portion 45 are arranged to face each other in the front-rear direction. Further, the bottom surface 54D of the inner locking arm 54 and the locking portion 45 face each other in the lateral direction, and the upper surface of the flat plate 51 of the inner locking arm 54 and the lower surface of the covering wall 35 face each other in the lateral direction. In this way, a rearward movement of the detecting member 50 is restricted, and the connecting operation of the connectors is completed. Note that the state where the rearward movement of the detecting member 50 is restricted can be released by strongly pulling the detecting member 50 rearward in separating the connectors.

Next, an excessive deflection preventing structure for the lock arm 40 is described.

Figure 13:
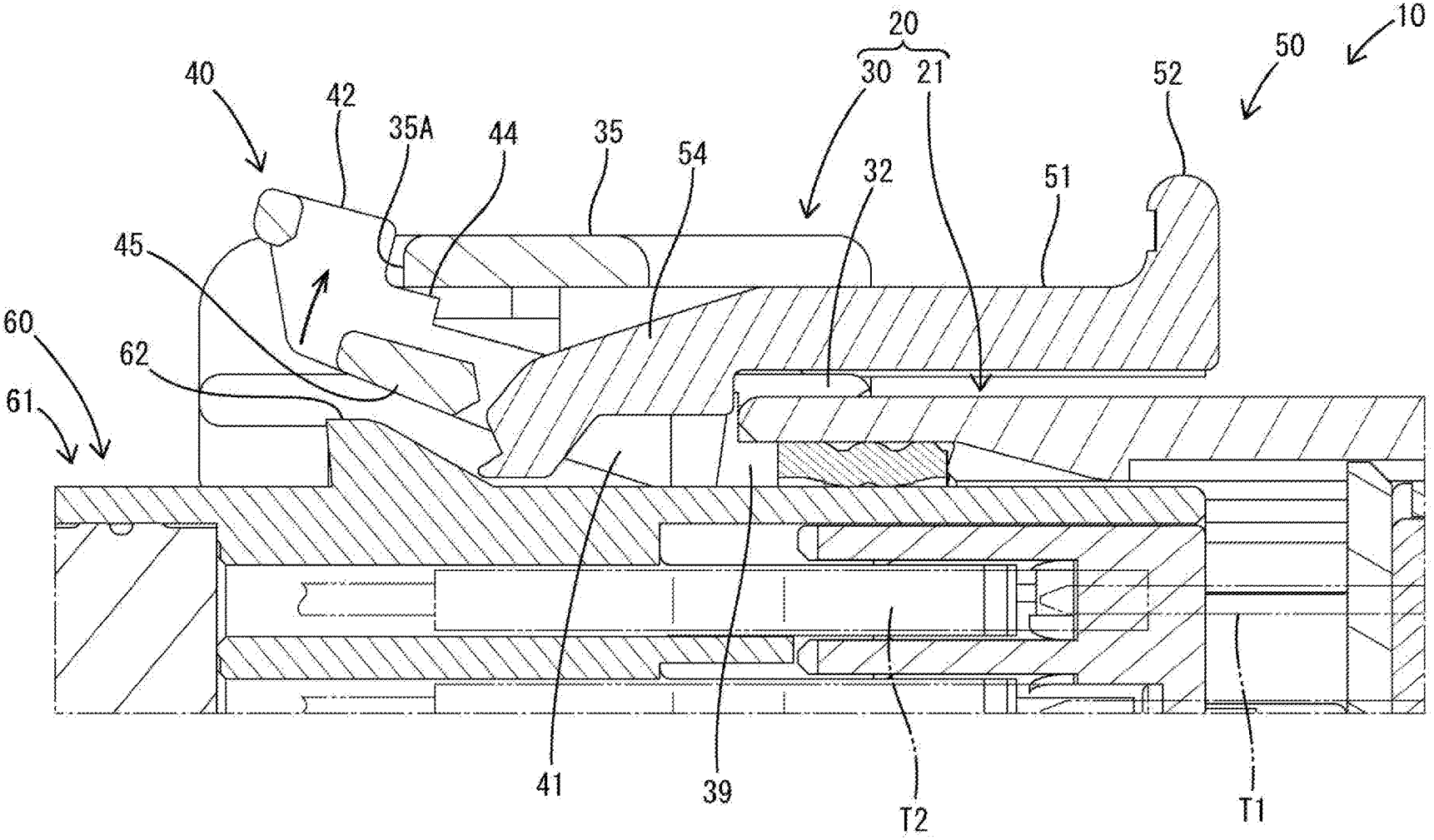
FIG. 13 is a plan view in section showing a state after a lock arm is deflected and deformed.

In the state shown in FIG. 8, the releasing portion 42 is lifted and displaced in a direction of an arrow of FIG. 13 (deflecting direction of the lock arm 40). Then, the lock arm 40 is deflected and deformed out (rightward) with the supports 39 as a fulcrum. Then, as shown in FIG. 13, the stoppers 44 of the lock arm 40 contact the front end 35A of the covering wall 35 from inside. Outward (rightward) displacements of the stoppers 44 are restricted by the front end 35A of the covering wall 35. Thus, the lock arm 40 can be prevented from being deflected and deformed any further.

As described above, the connector 10 has a function of restricting a movement of the detecting member 50 from the detection position and a function of restricting excessive deflection of the lock arm 40. Thus, these two functions need not be performed by separate configurations, and the connector 10 can be simplified in configuration.

The lock arm 40 includes the stoppers 44 configured to stop the detecting member 50 in contact therewith in the properly connected state. In this way, the stoppers 44 can restrict movement of the detecting member 50 from the detection position by stopping the detecting member 50 in contact therewith. Further, the housing 20 includes the covering wall 35 with which the stoppers 44 contact in the deflecting direction of the lock arm 40. In this way, any further deflection of the lock arm 40 can be prevented by contact of the stoppers 44 with the covering wall 35. As just described, the connector 10 has the function of restricting movement of the detecting member 50 from the detection position and the function of restricting excessive deflection of the lock arm 40. Thus, these two functions need not be performed by separate structures, and the connector 10 can be simplified in configuration.

Further, the lock arm 40 includes the releasing portion 42 configured to release the connection of the housing 20 and the mating housing 61. The stoppers 44 are integral to the releasing portion 42. In this way, the stoppers 44 and the releasing portion 42 are integrated so that the lock arm 40 can be simplified in configuration.

The stoppers 44 are integral to the releasing portion 42 on the free end side of the lock arm 40. Thus, the deflection and deformation of the free end side can be prevented with the stoppers 44 held in contact with the covering wall 35. Thus, excessive deflection of the lock arm 40 can be prevented reliably.

Further, the lock arm 40 includes the two stoppers 44 and is connected to the two stoppers 44 via the releasing portion 42. Thus, the releasing portion 42 functions as a beam between the stoppers 44 so that the rigidity of the lock arm 40 can be ensured.

The invention is not limited to the above described and illustrated embodiment. For example, the following embodiments also are included in the scope of the invention.

Although the stoppers 44 are integral to the releasing portion 42 at the adjacent positions in the above embodiment, the stoppers 44 may be separated from the releasing portion 42 in the lock arm 40.

Although the stoppers 44 are integral to the releasing portion 42 on the free end of the lock arm 40 in the above embodiment, the stoppers 44 may be coupled at a location (e.g. location on a base end or location in a longitudinal center of the lock arm 40) other than the free end side.

LIST OF REFERENCE SIGNS

10 . . . connector
20 . . . housing
35 . . . covering wall (contact portion)
40 . . . lock arm
42 . . . releasing portion
44 . . . stopper
50 . . . detecting member
60 . . . mating housing

What is claimed is:

1. A connector, comprising:

a housing having a receptacle extending in front to rear directions and open at front and rear ends and configured to hold a mating housing inserted from the front;

a resiliently deflectable lock arm extending in the front to rear directions between front and rear lock arm ends, the rear lock arm end coupled to an inner surface of the receptacle at a rear end thereof, and a stopper formed on the front lock arm end; and a detecting member inserted into the rear end of the receptacle configured such that a movement from a standby position to a detection position is restricted in a state where the housing and the mating housing are not connected properly and a movement to the detection position is allowed in a properly connected state of the housing and the mating housing; wherein:

the detecting member contacts the stopper from behind when the housing and the mating housing are in the properly connected state to prevent further forward movement of the detecting member; and the housing includes a contact portion, the stopper coming into contact with the contact portion in a deflecting direction of the lock arm.

2. The connector of claim 1, wherein:

the lock arm includes a releasing portion configured to release connection of the housing and the mating housing; and the stopper is integral to the releasing portion.

3. The connector of claim 2, wherein the stopper is integral to the releasing portion on a free end side of the lock arm.

4. The connector of claim 3, wherein the stopper is a first stopper and the lock arm (40) further includes a second stopper and the lock arm is connected to the stoppers via the releasing portion.

* * * * *